United States Patent [19]

Hudspith

[11] Patent Number: 4,955,469

[45] Date of Patent: Sep. 11, 1990

[54] CONVERTIBLE CONTAINER

[75] Inventor: Derick Hudspith, New York, N.Y.

[73] Assignee: R. G. Barry Corporation, Pickerington, Ohio

[21] Appl. No.: 403,398

[22] Filed: Sep. 6, 1989

[51] Int. Cl.[5] ..... B65D 5/52

[52] U.S. Cl. ..... 206/45.23; 206/45.2; 206/45.31; 229/162

[58] Field of Search ..... 206/45.2, 45.21, 45.23, 206/45.24, 45.25, 45.31; 229/162

[56] References Cited

U.S. PATENT DOCUMENTS

| | | | |
|---|---|---|---|
| 793,803 | 7/1905 | Parsons | 206/45.23 |
| 1,590,683 | 6/1926 | Helfrich | 206/45.21 |
| 2,167,947 | 8/1939 | Hayes | 206/45.21 |
| 2,695,097 | 11/1954 | Easton | 206/45.21 |
| 2,716,485 | 8/1955 | Hecker | 206/45.25 |
| 3,071,307 | 1/1963 | Keller | 206/45.21 |
| 3,353,658 | 11/1967 | Ettin | 206/45.25 |

*Primary Examiner*—David T. Fidei

*Attorney, Agent, or Firm*—Watson, Cole, Grindle & Watson

[57] ABSTRACT

A packaging container for various articles adapted to serve as both a display container as well as a self-wrapping container suitable for gift-giving. The packaging container comprises a front wall, a back wall, a top wall, a bottom wall and two end walls joined to each other to form an enclosure of a generally rectangular configuration. The top wall has an opening therein for display of articles contained with in the enclosure. The container further includes a closure panel secured to one of the walls and capable of being extended over the opening in the top wall as well as being capable of being folded about the side wall to reveal the opening. The closure panel has means for securing the panel to one of the walls.

3 Claims, 2 Drawing Sheets

CONVERTIBLE CONTAINER

BACKGROUND OF THE INVENTION

The present invention relates to a packaging construction and, more particularly, to a packaging construction which is able to serve both as a display packaging container as well as a self-wrapping packaging container suitable for gift-giving.

In the retail merchandising of products to customers, it has been long found that the sales are generally enhanced if the particular product being offered for sale is attractively presented to the customer at the point of sale. Many packaging constructions are known for this purpose and one particularly popular construction is a generally rectangularly shaped package containing the product which has a fairly large opening or window therein so the product can be viewed from the exterior. Attractiveness of the packaging is further enhanced if the opening is covered with a sheet of transparent material to give the appearance of a glass-paned window.

Furthermore, it is desirable for merchandisers of products, particularly those offering products for the so-called upscale market, to provide appropriate packaging or wrapping services such that the product can be conveniently presented as a gift by the purchaser. Generally these packages or wrapping services to make the article suitable for gift-giving at point of purchase are provided as an adjunct to merchandizing by the retailer at a reduced or at no cost to the customer. Obviously, if the overhead for these gift-wrapping services and supplies could be reduced or even eliminated, the merchandiser would realize improved efficiency and profitability. It would therefore be desirable to have one packaging container for articles and products which could be used to both enhance the display appearance of the articles as well as serving an attractive container for gift purposes.

SUMMARY OF THE INVENTION

It is therefore a feature of the present invention to provide a package construction which, in its one folded form, serves as an attractive display package to enhance the appearance of an article so as to improve sales of the contained product or article and which, in its second folded form, serves as a closed package suitable for presentation as a gift by the ultimate purchaser.

It is another feature of the invention to provide a packaging container which, in its second folded form, may also serve as a shipping container to protect the contents of the container from soiling and other damage during transit to a merchandiser prior to reaching the intended point of sale.

It is another feature of the present invention to provide a construction for a packaging container which includes means for easily and securely maintaining the package in its first and second folded forms and for facilitating changing the container from one form to another.

It is also a feature of the present invention to provide a packaging container which can be easily and simply constructed from an integral blank capable of being produced on conventional fiberboard box and container forming equipment.

Briefly, in its broader aspects, the present invention comprehends a packaging container comprising a front wall, a back wall, a top wall, a bottom wall and two end walls joined to each other to form an enclosure of a generally rectangular configuration, the top wall having an opening therein for display of articles contained within the enclosure, the container further including a closure panel secured to one of the walls and capable of being extended over the opening in the top wall as well as being capable of being folded about the side wall to reveal the opening, the closure panel having mean for securing the panel to one of the walls.

The present invention further comprehends a container comprising a top wall, a bottom wall and four side walls joined to each other to form an enclosure of a generally rectangular configuration, the top wall having an opening therein for display of articles contained within the enclosure, the container further including a closure panel secured to one of the walls and capable of being extended over the opening in the top wall as well as being capable of being folded about a side wall to reveal the opening, the closure panel having means for securing the panel to one of the walls.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 2:
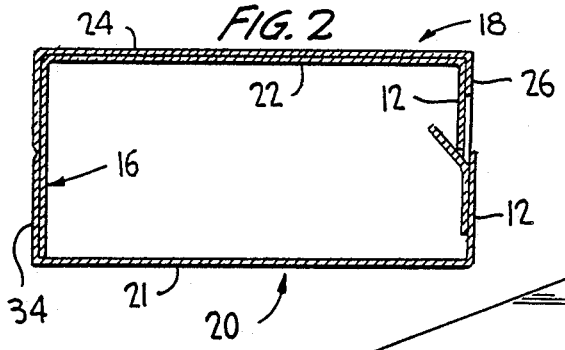
FIG. 2 is a cross-sectional view of the container taken along line 2—2 of FIG. 1.
Figure 1:
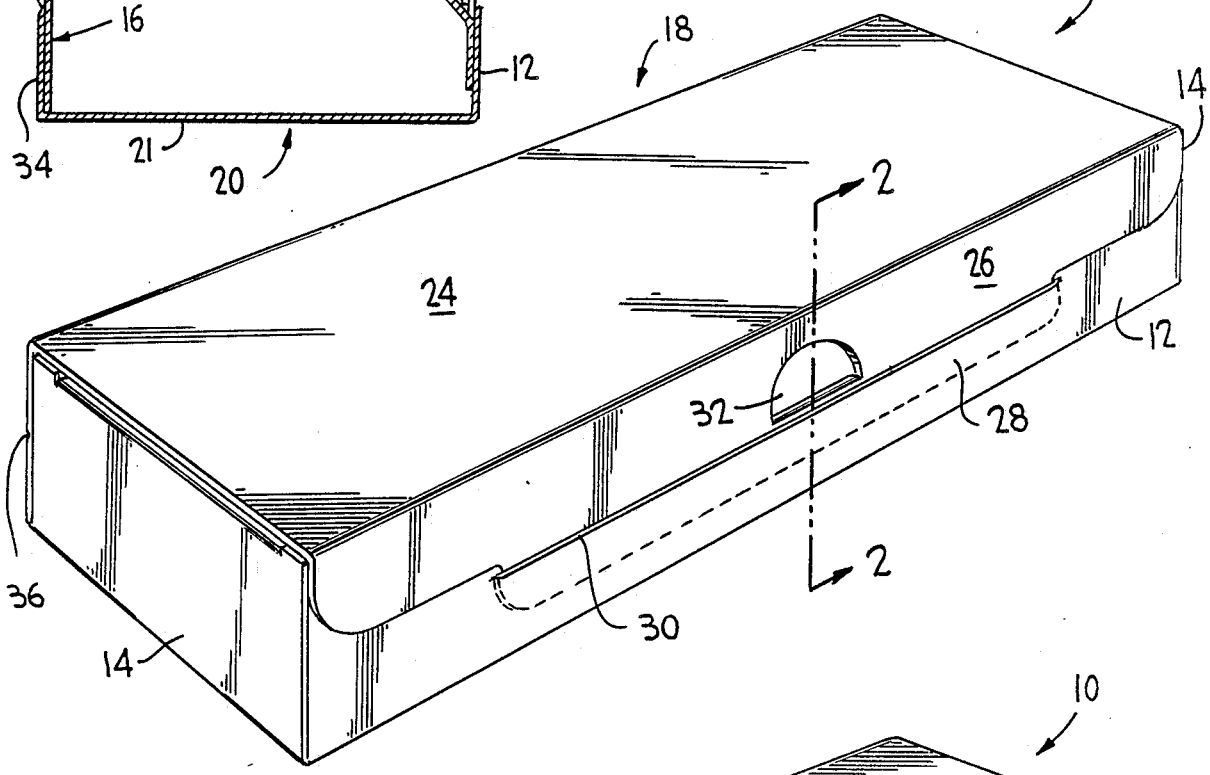
FIG. 1 is a perspective view of a packaging container according to the present invention, the container being shown in its first folded position such that the container is suitable for shipping articles and for gift-giving purposes.

Referring first to FIGS. 1 and 2, shown is container 10 in accordance with the present invention, the container being shown in its first folded position which is suitable for shipping as well as for gift-giving purposes for the article or articles contained within. Container 10 is of generally rectangular configuration having front wall 12, two side walls 14, inner back wall 16, top surface 18, and bottom surface 20. The basic box-like configuration for container 10 may be formed by folding connecting walls and providing suitable tabs on various wall for engaging the adjacent walls or alternatively by suitable adhesives joining the walls to one another in conventional manners as is known in the art.

As is best shown in FIG. 2, top surface 18 of container 10 in this folded form comprises lower top wall 22 and upper top wall 24 lying adjacent to one another in a close contiguous relationship. Upper top wall 24 includes flap 26 which extends over front wall 12, the flap having tab 28 (shown in phantom lines in FIG. 1) which engages slit 30 in the front wall to securely maintain the upper top wall in the position shown. Slit 30 in front wall 12 extends parallel to the adjacent edges of bottom wall 20 and upper top wall 24 and is spaced approximately equidistant therefrom. In this embodiment, flap 26 also includes a semi-circular aperture 32 which provides a convenient fingerhold for the flap to facilitate its removal from slit 30 so to enable the contents of container 10 to be revealed or to change the container to its alternate form.

Also shown in FIG. 2 is outer back wall 34 which is connected to upper top wall 24 as well as to bottom wall 21, preferably by being integral therewith. Outer back wall 34 has fold line 36 (see FIGS. 1, 3 and 4) running the length of container 10 and is preferably spaced approximately equidistant from the adjacent edges of inner upper wall 22 and bottom wall 21. The lower portion of outer back wall 34 is securely joined to inner back wall 16 by adhesives or the like. As is apparent from FIG. 2, all the components of container 10 as described above in this embodiment are formed from a single or unitary sheet of material such as fiberboard or pasteboard.

Figure 3:
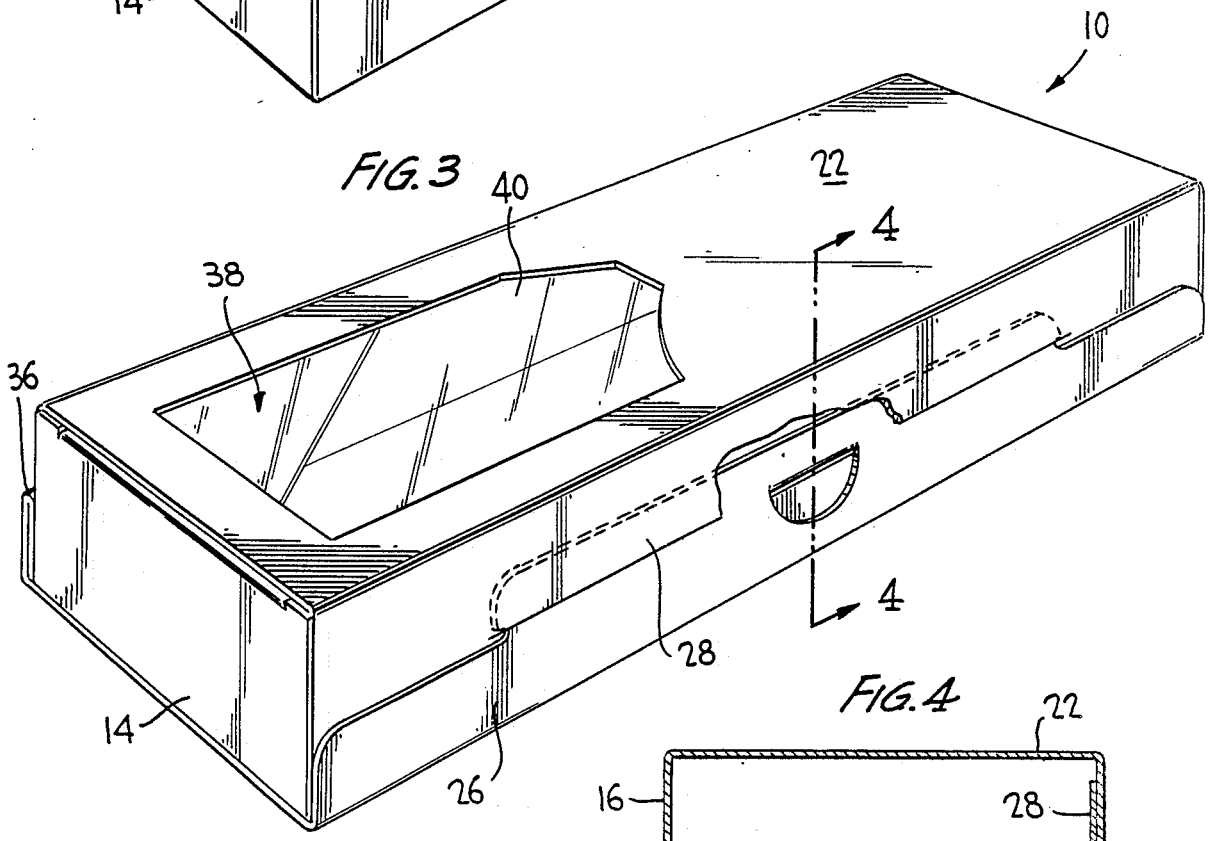
FIG. 3 is a perspective view of the container of FIG. 1 with the container being in its second folded position suitable for displaying an article contained within the container.
Figure 4:
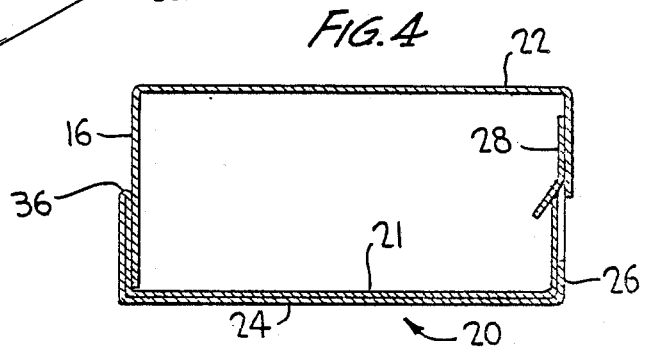
FIG. 4, is a cross-sectional view of the container taken along line 4—4 of FIG. 3.

Turning now to FIGS. 3 and 4, container 10 is shown in its alternate folded form from FIGS. 1 and 2 which has been formed by releasing tab 28 from slit 30 and then folding upper top wall 24 about fold line 36 on outer back wall 34 such that upper top wall 24 becomes adjacent to and contiguous with bottom wall 21. Tab 28 is inserted in slit 30 of front wall 12 so as to maintain this configuration for container 10. As is apparent, by moving upper top wall 24 from its position overlying lower top wall 22, window or opening 38 formed in the upper top wall is revealed making container 10 suitable as a display for the contents contained therein. Preferably, opening 38 can be covered by sheet 40 of transparent material such as glassine or the like, to further enhance the appearance of container 10 as well as the contents of the container. In the embodiment shown, opening 38 occupies approximately one half of the surface of lower top wall 22 and is of an arbitrary configuration shape. However, opening 38 can take any desired shape ,size or configuration.

Figure 5:
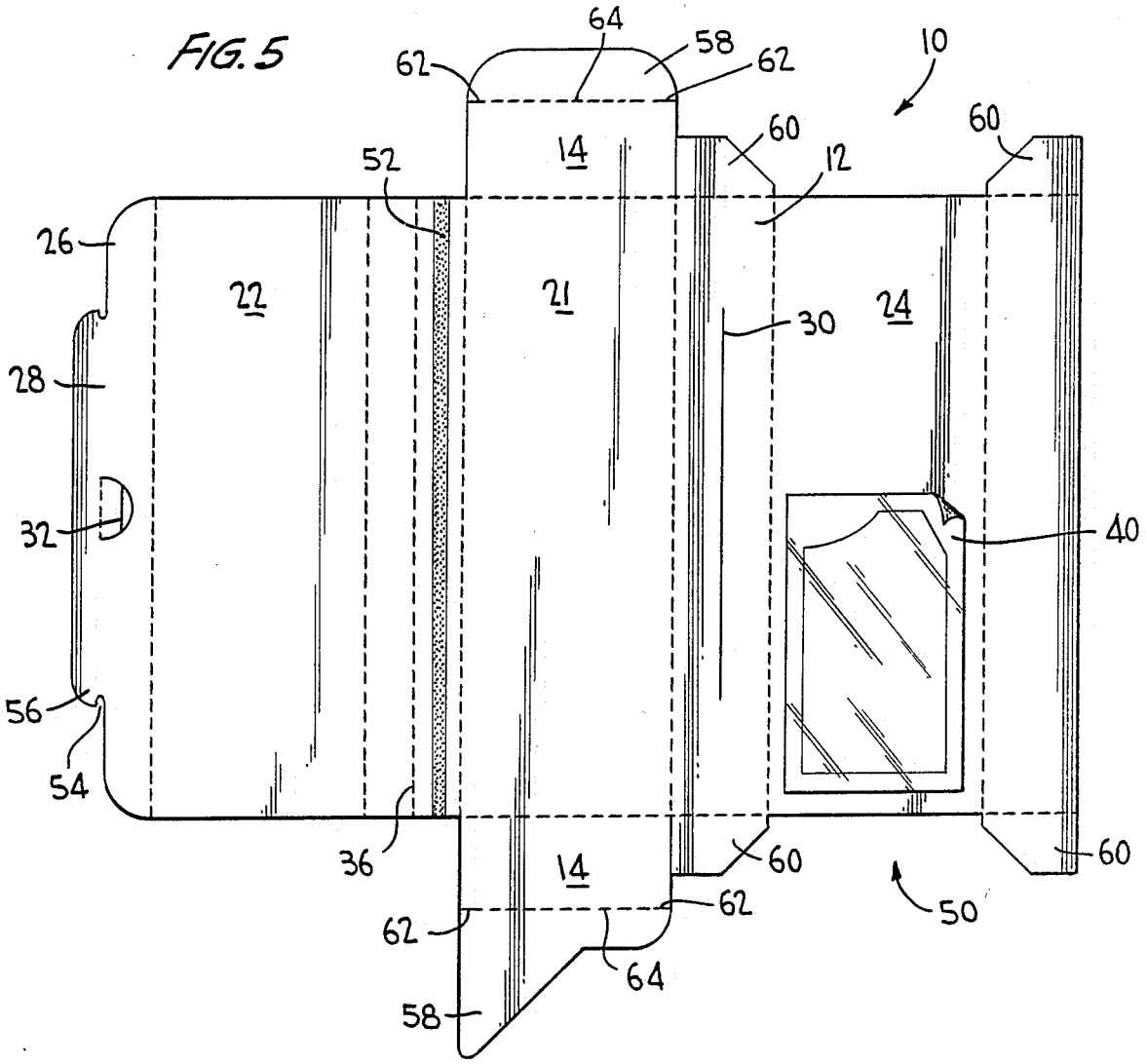
FIG. 5 is a plan of a blank suitable for constructing the container shown in FIGS. 1 through 4.

Turning now to FIG. 5, shown is one embodiment of a blank used for forming the container 10 as illustrated in FIGS. 1 through 4. Blank 50 is cut or die punched from a sheet or web of suitable material such as fiberboard, pasteboard, cardboard or the like so as to have the configuration shown and a line of adhesive 52 applied to the lower portion of outer back wall 34. Fold lines as shown by the dashed lines are formed on the blank 50 by scoring, bending and the like as is known in the art and slit 30 is formed in front wall 12. Transparent sheet 40 is applied over opening 38 by suitable means such as adhesives, tape, melting by the application of heat or similar methods known in the art.

It should be noted that in the embodiment of blank 50 shown in FIG. 5, closure tab 28 has cutouts or slits 54 along the line delineating the tab from flap 26 so as to define ears 56. The length of tab 28 between cutouts 54 is approximately equal to the length of slit 30 such that when the tab is inserted into the slit, the ears tend to securely lock the tab in that position. Ears 56 of tab 28 are of a relatively minor length so that tab 28 may be quite easily inserted into slit 30.

In this embodiment of FIG. 5, end walls 14 are provided with extending tabs 58 and front wall 12 and inner back wall 16 have extending tabs 60. When blank 50 is folded into the configuration of container 10 as shown in FIGS. 1 and 3, these tabs 58 and 60 help maintain the structural integrity of the container, particularly for maintaining the end walls attached to the remainder of the walls forming the top, front and back of the container, and also provide a convenient surface for the application of adhesive if so desired. In this particular embodiment, tabs 58 attached to end walls 14 are provided with slits 62 on the distal ends of the fold line 64 connecting the tab with the end walls to enable the tabs 60 on the front and back walls to be securely engaged.

In FIG. 5, shown is the inner surfaces of container 10 to be formed from blank 50. To form container 10, the blank 50 is first folded along all the vertical dashed lines such that the free edge of inner back wall 16 is along the fold line between bottom wall 21 and outer back wall 36 and the inner back wall thereby comes into contact with adhesive strip 52 on the lower portion of the outer back wall and is secured thereto. Thereafter, tabs 60 on front wall 12 are folded inwardly and end walls 14 folded such that tabs 58 on the end walls are inserted in the space between the outer edge of the tabs 60 and the inner top wall 22. To complete the container 10, upper top wall 24 is either folded around inner top wall 22 or bottom 16 and closure tab 28 of flap 26 inserted into slit 30 in front wall 12.

Figure 6:
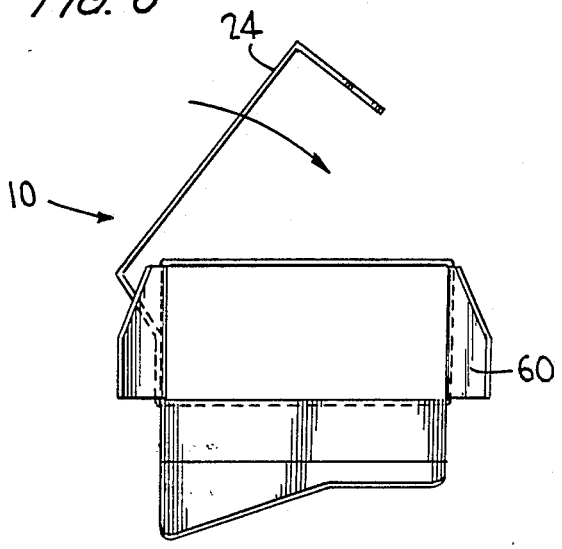
FIG. 6 is an end view of the blank of FIG. 5 as it is being folded into the container as shown in FIG. 1.
Figure 7:
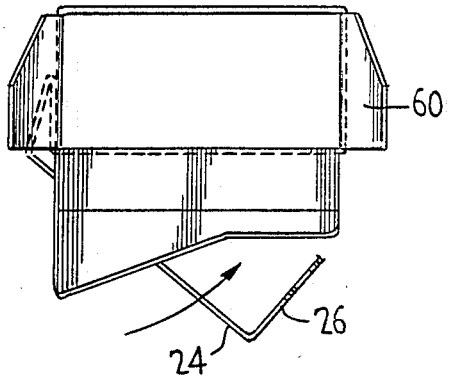
FIG. 7 is an end view of the blank of FIG. 5 as it is being folded into the container as shown in FIG. 4.

FIGS. 6 and 7 are end views of the container 10 further illustrating how upper top wall can be folded to make the container suitable for shipping or gift-giving (FIG. 6) or to make the container suitable for display purposes (FIG. 7) where opening 38 is revealed such that the contents of the container can be viewed from the exterior. These Figures also illustrate one tab 58 and both tabs 60 in the open position such that articles may be inserted into the container.

From the foregoing, it is readily apparent that container 10 in accordance with the present invention provides a distinct advantage over most conventional packaging containers in that it is suitable for shipping and gift-giving purposes in one folded configuration and is easily and quickly converted into an attractive display container so as to enhance the marketability of the container contents. While the container of the invention is suitable for packaging a wide variety of articles both large and small, it finds particular adaptability in the embodiment shown in packaging wearable items or articles such as slippers, shoes, gloves and the like.

While there has been shown and described what is considered to be preferred embodiments of the present invention, it will be apparent to those skilled in the art to which the invention pertains that various changes and modifications may be made therein without departing from the invention as defined in the appended claims.

It is claimed:

1. A packaging container comprising a front wall, a back wall, a top wall, a bottom wall and two end walls joined to each other to form an enclosure of a generally rectangular configuration, said top wall having an opening therein for display of articles contained within the enclosure, the container further including a closure panel secured to the back wall and capable of being extended over the opening in the top wall as well as being capable of being folded about the back wall to reveal the opening, the closure panel having one mean for securing the closure panel to the front wall when the closure panel is folded about the back wall and when the closure panel is extended over the opening, wherein the closure panel is hinged along a line about equidistant from the top wall and the bottom wall.

2. A container in accordance with claim 1 wherein the closure means on the closure panel comprises a tab capable of engaging a slit in one of the walls.

3. A container in accordance with claim 1 wherein the slit is in the front wall.

* * * * *